United States Patent [19]

Hampejs

[11] Patent Number: 4,907,492

[45] Date of Patent: Mar. 13, 1990

[54] APERTURED VALVE DISPOSED IN HOLLOW PISTON ROD OF FOLLOWER-TYPE MOTOR

[75] Inventor: Karl Hampejs, Neuhausen am Rheinfall, Switzerland

[73] Assignee: SIG Schweizerische Industrie-Gesellschaft, Neuhausen am Rheinfall, Switzerland

[21] Appl. No.: 203,258

[22] Filed: May 27, 1988

[30] Foreign Application Priority Data

Jun. 16, 1987 [CH] Switzerland ..... 2265/87

[51] Int. Cl.[4] ..... F15B 9/10

[52] U.S. Cl. ..... 91/49; 91/378

[58] Field of Search ..... 91/49, 368, 374, 376 R, 91/378, 390, 422, 222

[56] References Cited

U.S. PATENT DOCUMENTS

| | | | |
|---|---|---|---|
| 1,533,767 | 4/1925 | Schmidt | 91/378 X |
| 1,732,813 | 10/1929 | Kasley | 91/378 X |
| 2,738,770 | 3/1956 | Granzow | 91/378 X |
| 3,015,310 | 1/1962 | Faisandier | 91/378 X |
| 3,053,052 | 9/1962 | Garrison et al. | 91/378 X |
| 3,076,442 | 2/1963 | Raeber | 91/378 X |
| 3,228,305 | 1/1966 | Wills | 91/378 X |
| 3,757,640 | 9/1973 | Karol | 91/49 |
| 3,768,369 | 10/1973 | Knutson | 91/378 |
| 3,892,164 | 7/1975 | Magor | 91/378 |
| 3,961,561 | 6/1976 | Knutson | 91/378 |
| 4,085,920 | 4/1978 | Waudoit | 91/368 X |

FOREIGN PATENT DOCUMENTS

| | | | |
|---|---|---|---|
| 088017 | 7/1983 | European Pat. Off. . | |
| 2211994 | 9/1973 | Fed. Rep. of Germany . | |
| 562326 | 8/1923 | France | 91/378 |
| 1117743 | 3/1956 | France | 91/378 |
| 1163246 | 9/1958 | France | 91/378 |
| 654416 | 6/1951 | United Kingdom . | |

*Primary Examiner*—Robert E. Garrett
*Assistant Examiner*—George Kapsalas
*Attorney, Agent, or Firm*—Lewis H. Eslinger; Jay H. Maioli

[57] ABSTRACT

A piston is moveably arranged in a cylindrical bore of a housing and the piston rod extends through one end of the housing for connection to a unit to be controlled. A very high variable control rate of the piston is made possible by a control slide valve formed as a hollow cylinder that is moveable within a coaxial bore of the piston rod. The hollow, cylindrical, control slide valve contains a plurality of apertures that cooperate with ports formed in the piston rod that extends on either side of the piston. A chamber formed on one side of the piston is connected to a source of pressurized fluid and a chamber at the other side of the piston is connected to a return for such pressurized fluid. A control rod is connected to the control slide valve for moving same within the coaxial bore of the piston rod and by specially forming the guiding or leading edges of the apertures formed in the control slide valve, high variable control rates are possible.

9 Claims, 3 Drawing Sheets

APERTURED VALVE DISPOSED IN HOLLOW PISTON ROD OF FOLLOWER-TYPE MOTOR

BACKGROUND OF THE INVENTION

1. Field of the Invention

This invention relates generally to hydraulic servo-amplifiers and, more particularly, to a hydraulic linear servo-amplifier having a control valve that is controlled externally by a control rod.

2. Description of the Prior Art

There are already known hydraulic linear servo-amplifiers that include a piston that is arranged within a first cylindrical bore of a housing, in which a piston rod extends on either side of the actual sealing portion of the piston with one end of such rod extending out of the housing and having an end suitable for connection to the mechanism to be actuated. A control slide valve or spool valve is arranged in a bore in the piston rod, and the control slide valve is actuated by an operating rod that extends outside of the housing. An input connection for pressurized hydraulic fluid, for example, is connected with a first cylinder space at one side of the piston and a return outlet for such hydraulic fluid is provided in a second cylinder space at the other side of the piston. By providing lands and annular chambers of reduced diameter on the exterior cylindrical surface of the control slide valve, the valve then controls the flow of fluid from the first cylinder space into the second cylinder space. One example of such a hydraulic servo-amplifier is found in European Patent Application No. 0,088,017 published Sept. 7, 1983.

Such servo-amplifiers are particularly suitable to provide a small linear stroke and relatively low starting outputs. The control slide valve and operating rod are generally guided within a coaxial bore in the piston rod and the operating rod extends through the housing to the exterior so that it may be actuated by an electric motor, for example, a stepping motor. The control slide valve is then moved in accordance with the operating rod and the piston follows the linear movements of the control slide valve. The slide valve makes the appropriate connection between the fluid inlet and outlet and the chambers on either side of the piston ring by having reduced diameter portions that are defined by so-called guiding edges. Generally in this kind of servo amplifier, the ratio of the maximum flow cross-section by way of the guide edges to the piston surface is limited. In addition, the inflow or outflow of the hydraulic fluid to or from the respective so-called guiding edges take place through relatively narrow channels and the control rate of such known device is thereby substantially limited.

Other examples of servo amplifiers of this kind are found in U.S. Pat. No. 3,892,164 and 3,961,561. Nevertheless, these systems all exhibit the same disadvantages described above relative to the servo amplifier of the above-identified European Patent application.

SUMMARY OF THE INVENTION

Accordingly, it is object of the present invention to provide a hydraulic linear servo-amplifier that can eliminate the above-noted defects inherent in the prior art.

Another object of the present invention is to provide a hydraulic linear servo-amplifier having a control slide valve in which the guiding edges of the control slide valve are so arranged as to provide a very high variable rate.

In accordance with an aspect of the present invention, the control slide valve is formed as a hollow cylinder with apertures formed in the cylindrical wall thereof, wherein at least one edge of the aperture is designated as the so-called guiding edge that cooperates with a corresponding guiding or leading edge of a port in the piston rod, thereby to provide a larger effective control area.

By so constructing the slide valve as a hollow cylinder with the apertures and the so-called guiding edges of the slide valve apertures and the port in the piston rod, it is possible to eliminate the narrow channels that typically restrict the inflow or outflow of the hydraulic fluid. The two active piston surfaces can then be selected as desired in relation to the maximum opening cross-section of the guiding edges by use of an auxiliary piston, provided as a further feature of the present invention. In this way, the variable control mass can be further decreased. Furthermore, much smaller, and thereby more quickly reacting, motors can be used in place of the large stepping motors typically employed. Such smaller motors are available for use because the mass required to be accelerated directly by the motor is kept to a minimum.

The above and other objects, features, and advantages of the present invention will become apparent from the following detailed description of illustrative embodiments thereof to be read in conjunction with the accompanying drawings in which like reference numerals represent the same or similar elements.

DETAILED DESCRIPTION OF PREFERRED EMBODIMENTS

Figure 1:
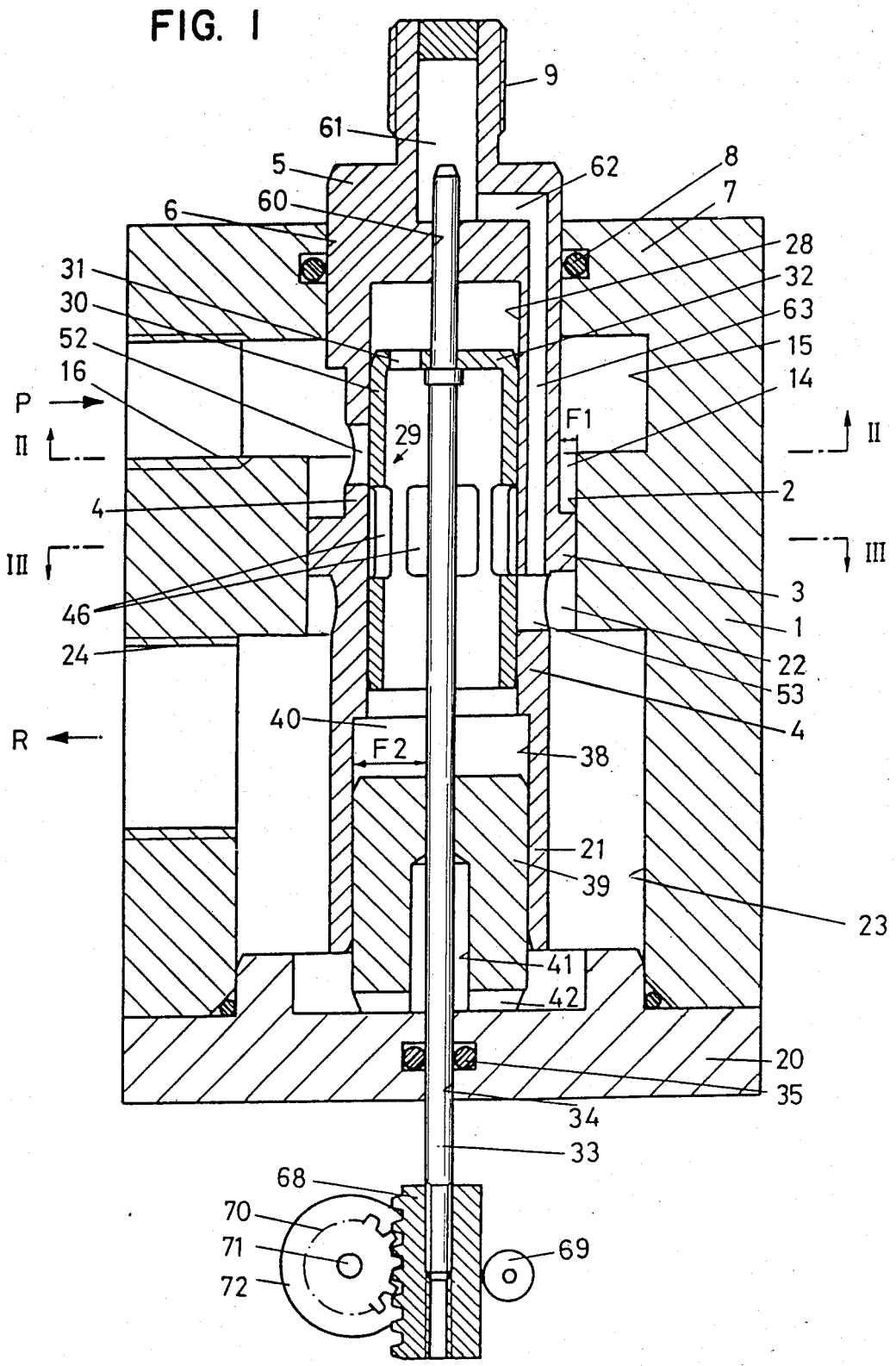
FIG. 1 is an elevational view in longitudinal cross-section of a hydraulic servo-amplifier according to an embodiment of the present invention.

In the embodiment of FIG. 1, a linear hydraulic servo-amplifier has a housing 1 with an axial bore 2 that has residing therein a piston 3 that can move axially within the bore 2. Piston 3 in this embodiment is a unitary element that includes a coaxial piston rod that extends on either side of the so-called ring portion of the piston 3 that is in sealing contact with bore 2 and is shown at 4 on either side of piston 3. Piston rod 4 includes a rod extension portion 5 that is guided through a portion of a bore 6 formed in one end 7 of the housing and is suitably sealed by a packing ring 8. The free end of piston rod extension 5 may be a reduced diameter element having a threaded portion 9 to which is attached the actual member to be actuated. A first cylindrical space 14 is formed by the housing end 7, piston rod extension portion 5, piston 3, and bore 2. This first cylindrical space 14 opens into an expanded housing bore 15 that is adjacent housing end 7. Bore 15 then communicates with the pressure connection 16 leading to the source of pressurized hydraulic fluid, shown generally at P.

A hydraulic fluid return space 22 is formed on the other side of piston 3 from first cylindrical space 14 by the piston 3, a housing end cover 20, a second extension portion 21 of piston rod 4, and bore 2 in housing 1. Just as first cylindrical space 14 opened into expanded housing bore 15, return space 22 opens into an enlarged housing bore 23 that is adjacent housing end cover 20. So too, enlarged housing bore 23 communicates with return connection 24 that is connected to the return line, indicated generally at R, of the hydraulic fluid.

Piston rod 4 has a coaxial bore 28 formed therein within which the control slide valve 29 is arranged for longitudinal movement. Control slide valve 29 is shown in more detail in FIG. 4, for example, and comprises a hollow cylinder having a cylindrical wall 30 and a front wall 32 facing piston rod extension portion 5, with a number of bores 31 located in front wall 32. The hollow cylinder of control slide valve 29 is open at the other end facing piston rod extension portion 21.

Attached to control slide valve 29 is an operating rod 33 that is guided for longitudinal movement by bore 34 through end cover 20 of housing 1. Operating rod 33 is sealed relative to housing end cover 20 by a suitable packing ring 35. Another coaxial bore 38 is formed in extension portion 21 of piston rod 4 and residing within bore 38 is an auxiliary piston 39 that closes the second cylindrical space 40 that is formed by the coaxial bore 28 in piston rod 4 and the other coaxial bore 38 in the extension portion 21 of piston rod 4 and is arranged to lie loosely on end cover 20. In order to reduce frictional forces between operating rod 33 nd auxiliary piston 39, auxiliary piston 39 is relieved by a bored-out center at 41 so as not to contact operating rod 33. The bored-out center 41 communicates with return space 22 by means of radial grooves 42 formed in he end surface of auxiliary piston 39.

Figure 4:
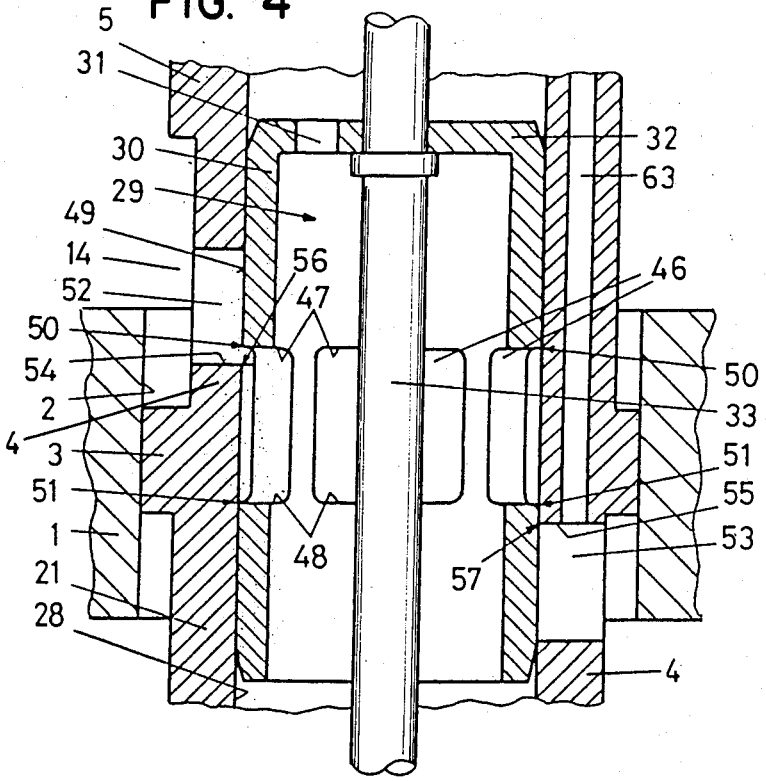
FIG. 4 is a detail showing a portion of the control slide valve of FIG. 1.

As shown on a larger scale in FIG. 4, there are four uniformly distributed, radially arranged apertures or so-called windows 46 of generally rectangular shape recessed into cylindrical wall 30 of control slide valve 29. The front walls 47 and 48 of each of the four windows 46, together with the outer surface 49 of cylindrical wall 30 form the so-called guiding or leading edges 50, 51 of the control slide valve 29. All of the guiding edges 50 and 51 for each of the four windows 46 lie in respective single radial planes.

Piston rod 4 includes three radial openings or ports 52, which are arranged above piston 3, in FIG. 1, and three radially arranged openings or ports 53 that are arranged below piston 3, in the orientation of FIG. 1. Thus, the front surfaces 54 of the three equidistantly arranged radial openings 52 that are above piston 3 form guiding or leading edges 56 of piston rod 4 and, similarly, the lower edges 55 of the three symmetrically arranged radial openings 53 also form guiding or leading edges 57 of piston rod 4. All of the guiding edges 56 and 57 for each of the two sets of three openings 52 and 53, respectively, lie in their own respective single radial planes, and approximately the same distance exists between the planes containing guiding edges 56 and 57 as exists between the planes containing guiding edges 50 and 51 on control slide valve 29.

Figure 3:
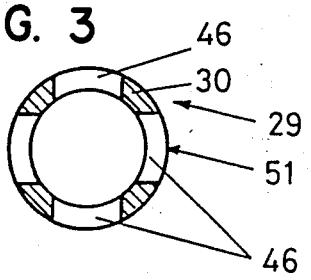
FIG. 3 is a cross-sectional view of the piston rod and control slide valve taken along section lines III—III in FIG. 1.
Figure 2:
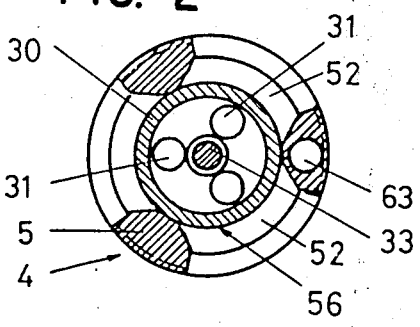
FIG. 2 is a cross-sectional view of the piston rod take along section lines II—II in FIG. 1.

As shown more clearly in FIGS. 2 and 3, the guiding edges 50, 51, 56, and 57 extend over most of the peripheral area of outer surface 49 or of bore 28, respectively.

In order to eliminate the pressures exerted upon control rod 33 at the end that extends into the smaller diameter threaded portion 9 of piston rod extension 5, a chamber 61 is formed that communicates through a radial bore 62 and a longitudinal bore 63 with one of the ports 53. Accordingly, chamber 61 is in communication with the return fluid connection 24 and no pressure resistance should be exerted against the end of operating rod 33.

At the end of operating rod 33 opposite chamber 61 is formed a rack gear 68 that is supported between a roller 69 and a pinion 70. Pinion 70 is fixed to a shaft 71 that comprises the drive shaft of an electric stepping motor 72. Thus, operation of the stepping motor 72 causes longitudinal movement of control rod 33 with corresponding linear motion being imparted to control slide valve 29.

In operation of the hydraulic linear servo-amplifier described above in relation to FIGS. 1 through 4, FIG. 1 represents the at-rest state, in which control slide valve 29 is maintained in position by control rod 33. Piston 3 therefore moves until its guiding edges 56 and 57 lie in relation to guiding edges 50 and 51 of control slide valve 29 so that the product from piston ring surface $F_1$ formed by bores 2 and 6 times the inlet pressure of the hydraulic fluid P is in equilibrium with the product from piston ring surface $F_2$ formed by bore 38 and operating rod 33 times the pressure that is present in space 40. There may be, of course, also some possible pressure effects of the return pressure R plus any outside forces acting on piston rod 4 that make contribute to the pressure in space 40. Then, if operating rod 33 and, thus, control slide valve 29, are caused to be moved upwardly, in the orientation of FIGS. 1 and 4, the aperture between the guiding edges 50 and 56 will open and the pressurized hydraulic fluid in chamber 14 will flow in through windows 46 into the second cylindrical space 40 and, accordingly, piston 3 and piston rod 4 will move upwardly as well. Piston 3 will then follow control slide valve 29 until the at-rest state described above is again established. If control slide valve 29 is caused to move downwardly, relative to the orientation of FIGS. 1 and 4, by means of control rod 33, the control opening formed by guiding edges 51 and 57 will be opened and hydraulic fluid will flow from the cylindrical space 40 to return connection 24.

The cross-sectional opening formed as above by the intervals of the guiding edges 50 and 56 or 51 and 57 and the periphery of the outer surface 49 of the control slide valve 29 relative to the surface of auxiliary piston 39 is large, and the hydraulic fluid flow over the guiding edges is not hindered or limited by any narrow channels, so that the attainable piston rate of movement is high. Furthermore, the active piston surfaces $F_1$ and $F_2$ can be selected to be as small as desired relative to the cross-section of the control slide valve 29. Also, because there are no small cross-section fluid columns that are to be accelerated, the mass moment of inertia effects of the accelerated fluid in the system are negligible relative to the mass of piston rod 4. Because apertures 46 are uniformly distributed about the periphery of control slide valve 29 and, similarly, ports 52 and 53 are uniformly distributed about the periphery of piston rod 4, there are no radial forces exerted on control slide valve 29 during operation. Furthermore, because of the difference in the number (four) of apertures 46 in relation to the number (three) of openings 52 and 53, the rotational position of control slide valve 29 relative to piston rod 4 is not consequential. Furthermore, note that the sealing of operating rod 33 is necessary only against the return pressure and, thus, it is possible to provide such sealing with relatively low friction. Furthermore, because it is desirable to use as small a stepping motor as possible, so as to provide as high dynamics as possible, operating rod 33 is kept to a relatively small diameter and control slide valve 29 is provided as a hollow cylinder having thin walls, so that only a small total mass must be accelerated by drive motor 72.

The hydraulic servo-amplifier provided by the present invention is particularly suitable for uses in which very high variable control rates are necessary and/or in applications where variable strokes with moderate power transmission are required. Typical of such applications includes, textile machines in which the invention is used to regulate the needle beams or needle bars, or in embroidering machines for needle or embroidering frame movement. Also in assembly or packing machines the invention can be used for equipping conductor plates, stuffing brushes, labelling, marking, dosing, pushing, pulling, bending, folding, shaking, vibrating, and stuffing. In addition, in machine tools or devices the invention can be used as pliers or lever activation, for example, in stamping, pressing, modeling, punching, pulling, hammering, rivetting, fine forging, nibbling, jacking, rapid punching, cutting stroke dampers and holding-down devices in stamping presses. Also, control or drive of injection valves in injection machines, spring manufacture, tool testing machines and as a control for drive elements, in injection pumps in combustion engines, dosing pumps in mixing units, mixing valves, rapid couples, hydraulic proportional valves, and hydraulic pump regulators to name only a few of the various applications to which the present invention may be applied.

Figure 5:
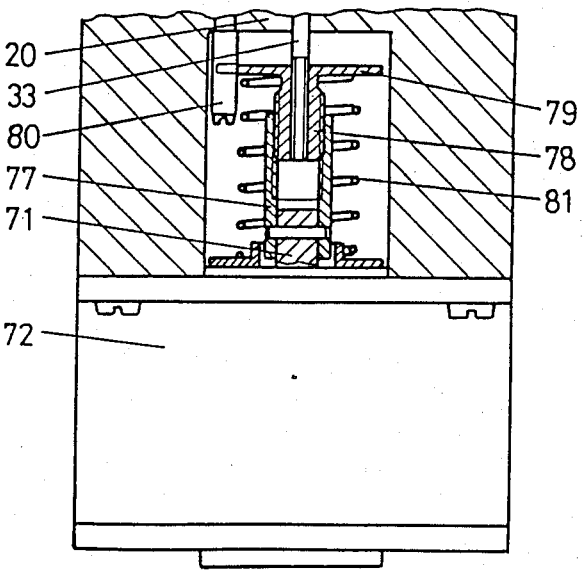
FIG. 5 is a cross-sectional view of a portion of a hydraulic servo-amplifier according to another embodiment of the present invention.

In FIG. 5, another embodiment of the present invention is shown in which the manner in which control rod 33 is driven in longitudinal motion differs from that shown in FIG. 1. More specifically, in the embodiment of FIG. 5, the drive of operating rod 33 is a screw drive in distinction to the rack and pinion drive of the embodiment of FIG. 1. In FIG. 5, externally threaded sleeve 77 is threadedly attached to a threaded pin element 78 that is in turn threaded onto operating rod 33. Threaded sleeve 77 has threaded thereon drive shaft 71 of stepping motor 72, which in this embodiment is now arranged coaxially with operating rod 33 and piston rod 4. Threaded pin element 78 includes a flange 79 which prevents pin 78 from twisting off of operating rod 33 by engaging a pin 80 that is attached to housing end 20. A spring 81 is provided to load flange 79 so that the screw drive of FIG. 5 is free from play.

Figure 6:
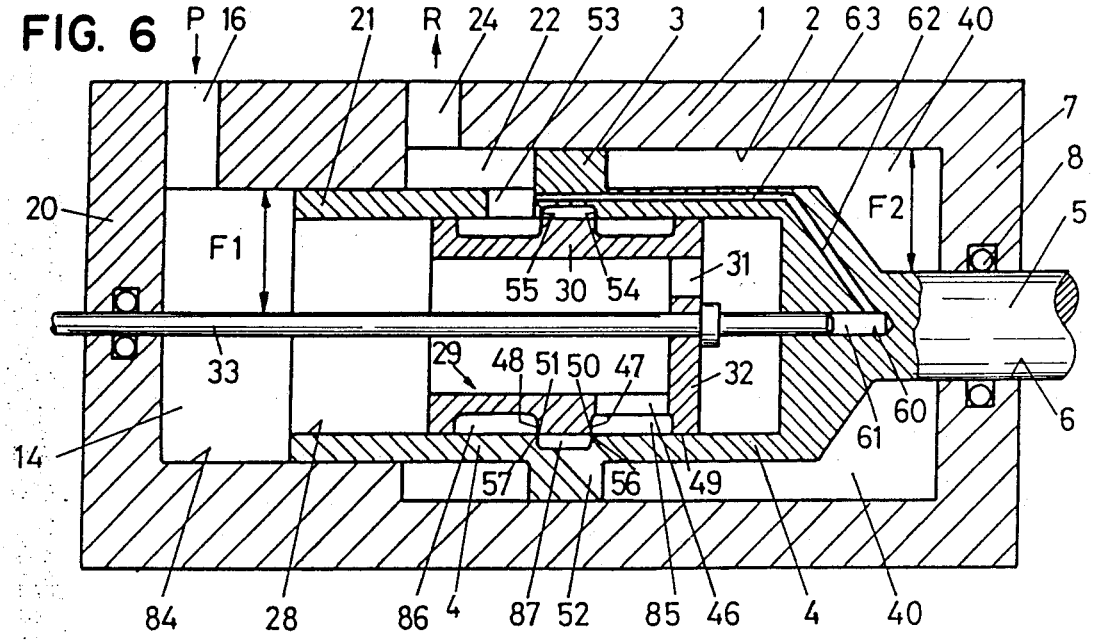
FIG. 6 is an elevational view in cross-section of a hydraulic servo-amplifier according to a further embodiment of the present invention.

Another embodiment of the present invention is shown in FIG. 6 in which the auxiliary piston 39 of FIG. 1, is formed by the second extension portion 21 of piston rod 4, which sealing by slides in a bore 84 of housing 1. The first cylindrical space 14, which is connected with pressure inlet connection 16, in this embodiment is formed by bore 84. Thus, annular chamber $F_2$ of the second cylindrical space 40 is formed between bore 6 and the outer surface of the piston rod extension 5 or, stated in another way, between bores 2 and 6, is larger than the effective annular area $F_1$ of the first cylindrical space 14. Control slide valve 29 is once again a hollow cylinder and includes the apertures 46 that here are in fluid communication with peripheral groove 85 on the exterior of control slide valve 29. Since FIG. 6 is rotated 90° from the showing in FIGS. 1 and 4 of the first embodiment, the control slide valve 29 moves in a left-right movement and, thus, a left-hand or lower face of peripheral groove 85 that faces piston 3 and together with the outer surface 49 of control slide valve 29 form a guiding edge 50 of control slide valve 29. The other guiding edge 51 of control slide valve 29 is formed by a right-hand or upper front wall 48 of another peripheral groove 86 that also faces piston 3. Peripheral groove 86 is also formed o the exterior of control slide valve 29.

The two guiding edges 56 and 57 that are part of the piston rod 4 are formed by two edges or surfaces 54, 55 of an inner circumferential groove 87 formed in piston rod 4 at the location of piston 3. Inner circumferential groove 87 in piston rod 4 is at the same location as the piston ring 3 and groove 86 in control slide valve 29 is connected by radial openings or ports 53 in the extension portion 21 of piston rod 4, which are in communication with return space 22. Inner groove 87 in piston rod 4 is in communication with the cylindrical space 40 by means of openings or ports 52 formed in piston rod 4 substantially at the location of piston ring 3. The operation of the embodiment of FIG. 6 is the same of the operation of the embodiment shown in FIGS. 1 and 4.

Figure 7:
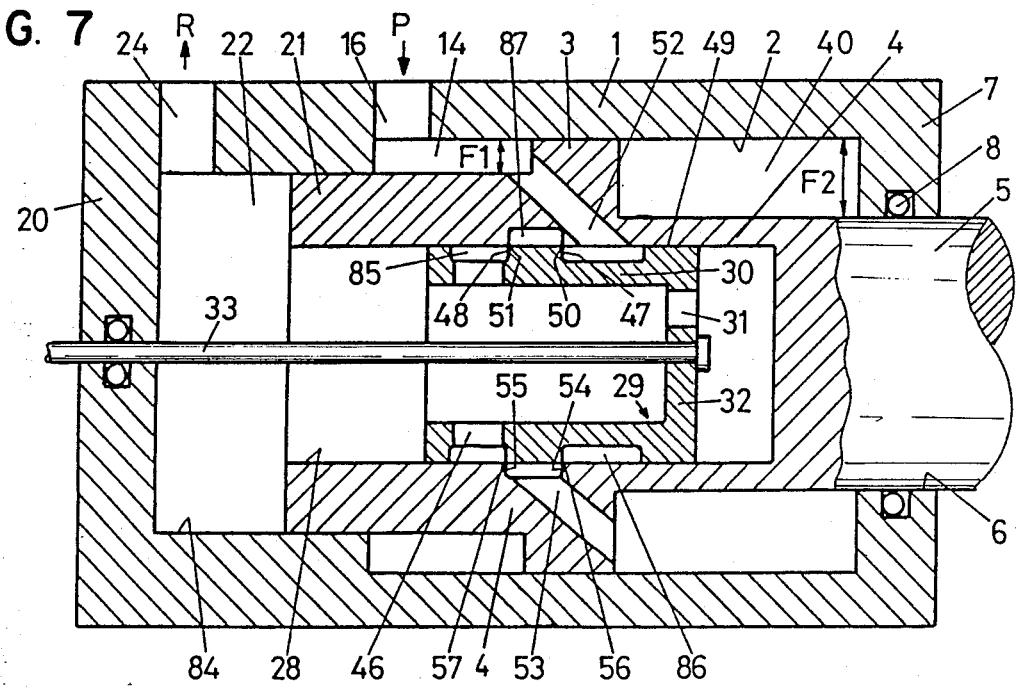
FIG. 7 is an elevational view in cross-section of a hydraulic servo-amplifier according to yet another embodiment of the present invention.

Another embodiment of the present invention is shown in FIG. 7 that is analogous to that of FIG. 6, however, in the embodiment of FIG. 7 the locations of the inlet pressure connection 16 and the return fluid connection 24 are interchanged. Thus, the first cylindrical space 14 is loaded with the feed pressure presented at P and, thus, effect surface $F_1$ is arranged to the left of piston 3 in the embodiment of FIG. 7. Openings or ports 52 and 53 are formed in the piston rod 4 so that they cross over at such point and each stretches over less than half the circumference of the piston rod 4. Because the entire operating rod 33 is then loaded with the return pressure. It is not necessary to provide the pressure relief by bore 62 and 63 of the chamber 61, as required in the previously described embodiments.

Figure 8:
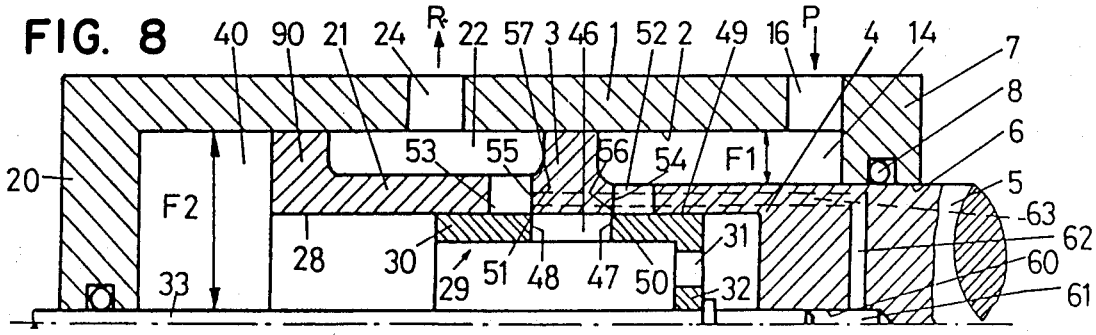
FIG. 8 is an elevational view in cross-section of a hydraulic servo-amplifier according to still a further embodiment of the present invention.

A portion of yet another embodiment is shown in FIG. 8 that is similar to that of FIG. 1 except that here in place of the auxiliary piston 39, a second flange 90 is provided at the lower extension portion 21 of piston rod 4. Flange 90 is arranged for movement within the same bore 2 of housing 1 as is piston 3. Subsequently, the effective surface area $F_2$ of the second cylindrical space 40 corresponds to the cross-section of bore 2 less the cross-sectional area of operating rod 33. Another variation in the embodiment of FIG. 8 is possible in which the diameter of flange 90 is smaller than the diameter of piston 3, thereby reducing the bore 2 at that location corresponding to that shown, for example, in the embodiment of FIG. 8.

The above description is given on preferred embodiments of the invention, but it will be apparent that many further modifications and variations could be effected by one skilled in the art without departing from the spirit or scope of the novel concepts of the invention, which should be determined by the appended claims.

What is claimed is:

1. A hydraulic linear servo-amplifier comprising:

a housing with a first cylindrical bore, a second cylindrical bore extending through a first end wall of the housing, and a third cylindrical bore extending through a second end wall of the housing, the second bore and the third bore being coaxial with and smaller than the first bore;

a first cylinder chamber formed in said housing;

a fluid supply connection in said housing communicating with said first cylinder chamber formed in said housing for supplying hydraulic fluid under pressure to said first chamber;

a second cylinder chamber formed in said housing;

a return connection formed in said housing communicating with a return chamber in said housing for returning fluid from said return chamber;

a piston slidably received in said first bore;

a piston rod connected to said piston and extending through said second bore, said piston rod having a coaxial cylindrical bore formed therein that is axially open toward said second end wall of said housing;

a slide valve member slidably received in said cylindrical bore of said piston rod and having a tubular, cylindrical wall, an end wall facing said first end wall of said housing and being axially open toward said second end wall of said housing, and a plurality of apertures formed through said cylindrical wall, with at least one respective edge of said apertures forming a first control edge;

a control rod extending through said third cylindrical bore in said housing and being fastened to said end wall of said valve member;

a passage formed in said piston rod and together with said cylindrical bore in said piston rod forming at least one second control edge cooperating with said first control edge for controlling flow of fluid through said apertures in said slide valve member and through said open axial end of said valve member into and out of said second cylinder chamber, respectively; and wherein said plurality of apertures formed in said cylindrical wall of said valve member are rectangular in cross-section, wherein first outer edges of said apertures laying in a first common radial plane form said first control edge and opposite outer edges of said apertures laying in a second, axially spaced-apart, common radial plane form a third control edge, wherein a first passage including a plurality of first radial slots formed in said piston rod communicates with said first cylinder chamber and together with said coaxial cylindrical bore in said piston rod forms said second control edge, and wherein a second passage including a plurality of second radial slots formed in said piston rod communicate with said return chamber and together with said coaxial cylindrical bore in said piston rod form a fourth control edge, wherein said first and second control edges cooperate for controlling fluid flow into the second cylinder chamber and said third and fourth control edges cooperate for controlling fluid flow out of the second cylinder chamber.

2. A servo-amplifier in accordance with claim 1, wherein said piston rod cooperates with an auxiliary piston arranged in said housing for closing one of said first and second cylinder chambers.

3. A servo-amplifier in accordance with claim 2, wherein said auxiliary piston has a smaller diameter than said piston.

4. A servo-amplifier in accordance with claim 3, wherein said auxiliary piston is slidably received in a second coaxial cylindrical bore formed in said piston rod and is penetrated by said control rod, and wherein a face of the piston located opposite said first cylinder chamber in said housing is arranged in said return chamber.

5. A servo-amplifier in accordance with claim 4, in which said auxiliary piston loosely abuts said second end wall of said housing and has grooves formed in a face thereof opposite said second cylinder chamber.

6. A servo-amplifier in accordance with claim 3, wherein said auxiliary piston is integrally formed with said piston rod and is slidably received in a fourth coaxial cylindrical bore formed in said housing.

7. A servo-amplifier in accordance with claim 2, wherein said auxiliary piston is integrally formed with said piston rod and is slidably received in a fourth coaxial cylindrical bore formed in said housing.

8. A servo-amplifier in accordance with claim 1, wherein an end of said control rod facing said first end wall of said housing is slidably received in a further axial bore in said piston rod and penetrates into a space in said housing in fluid communication with said return chamber.

9. A servo-amplifier in accordance with claim 1, wherein said control rod is connected to a pilot motor by a gearing element.

* * * * *